United States Patent [19]

Berry

[11] Patent Number: 4,568,219

[45] Date of Patent: Feb. 4, 1986

[54] ROAD GRADER

[75] Inventor: Vernon D. Berry, Winona, Kans.

[73] Assignee: Logan Western Road, Inc., Winona, Kans.

[21] Appl. No.: 616,680

[22] Filed: Jun. 4, 1984

[51] Int. Cl.[4] ..... E01C 19/22

[52] U.S. Cl. ..... 404/118; 172/787; 172/799.5; 172/684.5

[58] Field of Search ..... 404/85, 86, 119, 120, 404/118; 172/779, 780, 781, 786, 787, 799.5, 684.5

[56] References Cited

U.S. PATENT DOCUMENTS

| | | | |
|---|---|---|---|
| 981,437 | 1/1911 | Linder | 172/787 |
| 1,185,090 | 5/1916 | Hall | 172/787 |
| 1,303,415 | 5/1919 | Thurston | 404/118 |
| 1,476,263 | 12/1923 | Martin | 172/799.5 |
| 1,773,431 | 8/1930 | Mosel | 404/120 X |
| 1,845,324 | 2/1932 | Noffsinger et al. | 172/780 |
| 2,348,445 | 5/1944 | Bayer | 404/85 |
| 2,593,880 | 4/1952 | Heavilin | 172/780 |
| 3,435,546 | 4/1969 | Iverson | 172/780 |
| 3,883,259 | 5/1975 | Burg et al. | 404/120 |

FOREIGN PATENT DOCUMENTS

| | | | |
|---|---|---|---|
| 1024726 | 4/1953 | France | 404/120 |
| 1320899 | 6/1973 | United Kingdom | 404/118 |

*Primary Examiner*—James A. Leppink
*Assistant Examiner*—John F. Letchford
*Attorney, Agent, or Firm*—Litman, Day and McMahon

[57] ABSTRACT

A drag-type road grader including a skewable frame and a plurality of blade assemblies extending transversely across the frame. A tongue assembly is mounted on the frame and includes hydraulic cylinders for skewing the frame to alternative parallelogram-shaped configurations whereby the blade assemblies are angled with respect to the direction of travel. Retractable wheel assemblies are provided for transporting the grader in a non-working mode.

12 Claims, 12 Drawing Figures

10.
6.

12.

9.

ROAD GRADER

BACKGROUND OF THE INVENTION

1. Field of the Invention

The present invention relates generally to road grading equipment and in particular to a drag-type road grader.

2. Description of the Prior Art

Nonpaved roads comprising dirt, gravel and the like generally require periodic maintenance to repair the damage done thereto by vehicular traffic. A common maintenance procedure is to regrade and relevel the roads with equipment especially designed for this purpose. For example, self-propelled road graders are well known and may be provided with blades for scraping, leveling and reshaping a road surface. The blades are generally adjustably mounted with respect to height, pitch and angle relative to the direction of travel. For road grading purposes, the blades are usually oriented at an oblique angle with respect to the direction of travel so that excess road material flows transversely.

However, such self-propelled, conventional road graders have several drawbacks for the maintenance of roads comprising dirt, gravel and the like. First of all, generally only a single blade is mounted thereon. The single blade performs both cutting and filling operations wherein material is respectively removed from the high spots and deposited in the low spots. The only packing and compression of such redistributed material which occurs is by the rear wheels of the vehicle. Therefore, only the fractional portion of the blade's swath directly in the path of the vehicle rear wheels is compacted.

Secondly, self-propelled road graders operate best on relatively dry roads because their blades tend to stick in damp road materials. However, dry, loose material is susceptible to being blown out of level before being compacted by vehicular traffic. For example, pot holes filled under dry conditions with a single-blade road grader may be emptied and reopened by a high wind.

Yet another disadvantage of conventional, self-propelled road graders is their slow operating speeds. Excessive blade vibration or "chatter" typically occurs at speeds of approximately four miles per hour. The relatively slow operating speeds of such equipment tend to increase the cost of road maintenance therewith through such factors as labor, equipment usage, fuel consumption, maintenance and the amount of equipment required to maintain a given road network.

Drag-type road graders are also well known and are pulled along roads by tractors and the like. In fact, such drag-type road graders may be successfully employed in combination with self-propelled, single-blade road graders since the addition of the former can help compensate for the deficiencies of the latter. An exemplary drag-type road grader is shown in the Hall U.S. Pat. No. 1,185,090 and comprises a rectangular frame with a pair of blades extending thereacross at oblique angles. The Thurston U.S. Pat. No. 1,303,415 shows a frame with transverse blades. The frame members of the Thurston device are pivotally connected whereby the frame may be skewed to form a parallelogram to adjust the angles of the blades with respect to the direction of travel.

SUMMARY OF THE INVENTION

In the practice of the present invention, a road grader is provided which includes a frame having a pair of parallel, longitudinal trusses interconnected by rectangular subframes. Each subframe is pivotally connected to the trusses and includes a blade assembly. A tongue assembly extends along the direction of travel and the longitudinal axis of the grader and includes power cylinders for skewing the frame to parallelogram-shaped configurations by longitudinally shifting the trusses relative to each other and by rotating the subframes with respect to the trusses. The subframes are pivotally connected to the frame trusses by a plurality of hinge mechanisms with vertical, pivotal axes. A pair of wheel assemblies are retractably mounted on the frame for transporting the grader in a non-working mode.

OBJECTS OF THE INVENTION

The objects of the present invention are: to provide a drag-type road grader; to provide such a grader for roads comprising dirt, gravel and the like; to provide such a grader which is well adapted for working relatively damp roads; to provide such a grader with a plurality of transverse blades; to provide such a grader with a frame which may be skewed to angle the blades a desired amount relative to the direction of travel; to provide such a grader wherein the heights of the blades are independently adjustable; to provide such a grader which includes a blade for compacting redistributed material; to provide such a grader which includes an hydraulic system for skewing its frame; to provide such a grader which includes retractable wheels for towing in a non-working mode; to provide such a grader wherein the blades are independently and vertically adjustable; to provide such a grader which is efficient in operation, economical to manufacture, capable of a long operating life and generally well adapted for the proposed useage thereof.

Other objects and advantages of this invention will become apparent from the following description taken in conjunction with the accompanying drawings wherein are set forth, by way of illustration and example, certain embodiments of this invention.

The drawings constitute a part of this specification and include exemplary embodiments of the present invention and illustrate various objects and features thereof.

DETAILED DESCRIPTION OF THE PREFERRED EMBODIMENTS

Figure 3:
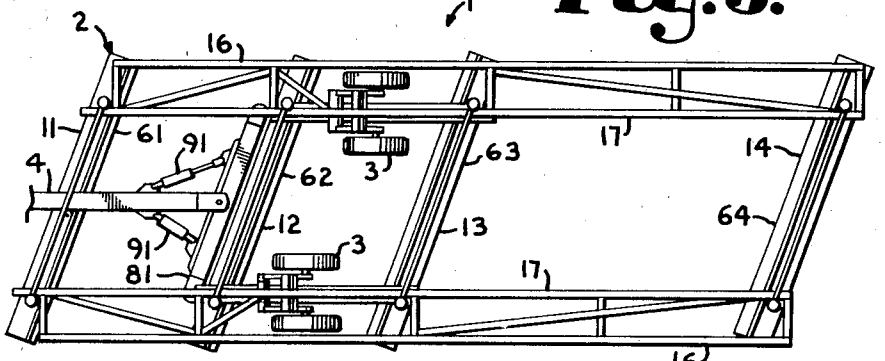
FIG. 3 is a top plan of the road grader in a second skewed configuration.

As required, detailed embodiments of the present invention are disclosed herein; however, it is to be understood that the disclosed embodiments are merely exemplary of the invention which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Referring to the drawings in more detail, the reference numeral 1 generally designates a road grader embodying the present invention. The road grader 1 generally comprises a distortable frame 2, a pair of retractable transport wheel assemblies 3 and a tongue assembly 4. First, second, third and fourth blade assemblies 11, 12, 13 and 14 respectively extend transversely across the frame 2. The frame 2 includes a pair of longitudinal trusses 16 each having upper, lower and outer rails 17, 18 and 19 rigidly interconnected by cords 20. The outer rails 19 are spaced equidistantly from the upper and lower rails 17 and 18 and form triangular configurations therewith when viewed from the end.

A plurality of hinge and blade depth adjustment mechanisms 25 are mounted on each truss above respective ends of the blade assemblies 11, 12, 13 and 14. Each hinge mechanism 25 includes inner and outer angle members 26, 27. The outer angle members 27 are welded to respective upper and lower rails 17, 18 and chords 20 at the intersections thereof and include four receivers for blade assembly mounting bolts 28.

The inner angle member 26 of each hinge mechanism 25 is welded to a respective upright hinge bushing 29 with upper and lower ends 30, 31 protruding above and below respective upper and lower rails 17, 18. The inner angle member 26 includes a plurality of elongated slots 32 for receiving the bolts 28 whereby the angle members 26, 27 are vertically adjustably connected. A hinge pin 37 comprising, for example, a length of hollow pipe having an outside diameter slightly less than the inside diameter of the hinge bushing 29 is inserted in the latter and rotatable with respect thereto about a vertical axis. Upper and lower collars 38, 39 are mounted on the hinge pin 37 at the upper and lower ends 30, 31 respectively. The upper collars 38 of the four transversely aligned pairs of hinge mechanisms 25 are interconnected by four tie rods 40.

Each blade assembly 11, 12, 13 and 14 includes a respective transverse torque tube 46 having a rectangular cross-sectional configuration. Each torque tube 46 is welded to a respective pair of lower collars 39. Blade mounting bars 47 are welded to the torque tubes 46 and include longitudinally spaced receivers for blade mounting bolts 49.

Figure 1:
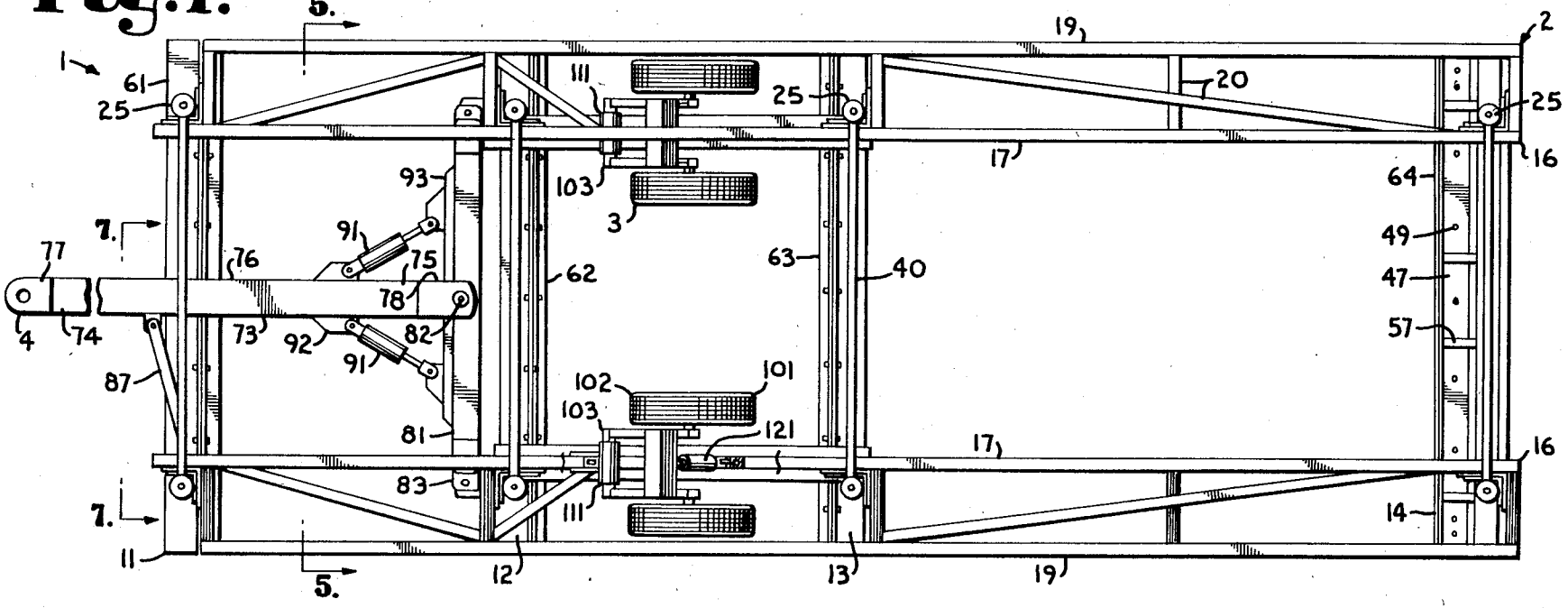
FIG. 1 is a top plan of a road grader according to the present invention.

First, second, third and fourth blades 51, 52, 53 and 54 are bolted on the blade mounting bars 47 of respective blade assemblies 11–14. Each blade 51–54 includes a proximate leg 55 with longitudinally spaced receivers for the bolts 49 and a distal leg 56 forming an obtuse angle with respect to the proximate leg 55. Although the blade mounting bars 47 and the blades 51–54 are substantially identical, they are mounted on the blade assembles 11–14 in different orientations for performing different functions. The first and second blades 51, 52 are oriented as shown in FIG. 1 for scraping with their distal legs 56 extending downwardly and rearwardly. The blade mounting bars 47 of the blade assemblies 11, 12 are welded on rear faces of respective torque tubes 46.

The blade mounting bar 47 of the third blade assembly 13 is welded on the front of the torque tube 46. The third blade 53 functions as a cutter and is bolted to the blade mounting bar 47 with its distal leg 56 extending forwardly in the direction of travel. The blade mounting bar 47 of the fourth blade assembly 14 is welded to a respective torque tube 46 along the bottom edge of its front face and slopes upwardly and forwardly therefrom forming an upwardly open acute angle with the front face of the torque tube 46. Spacers 57 are welded to the upper edge of the torque tube front face and to the blade mounting bar 47 of the fourth blade assembly 14. The fourth blade 54 is bolted to the blade mounting bar 47 with its proximate leg 55 sloping downwardly from front to back and its distal leg 56 substantially horizontal and positioned beneath the torque tube 46. The fourth blade 54 functions to compact and smooth the material scraped and cut by the preceeding blades 51, 52 and 53.

Associated tie rods 40 and torque tubes 46 are rigidly connected at their ends to respective hinge pins 37 by the collars 38, 39 whereby they are maintained in parallel, vertically spaced relationship. Associated tie rods 40; torque tubes 46; collars 38, 39; and hinge pin pairs 37 thus interconnected form rectangular first, second, third and fourth subframes 61, 62, 63 and 64. The third subframe 63 includes diagonal braces 65 connected to the tie rod 40 and the torque tube 46 at locations spaced slightly inwardly from the hinge pins 37. The diagonal braces 65 function to maintain the subframes 61–64, and particularly the third subframe 63, in rectangular configurations and to resist racking and twisting forces acting on the frame 2 about its longitudinal axis.

The tongue assembly 4 includes a tongue 73 extending generally along the longitudinal axis of the grader 1 with front and back ends 74, 75. The tongue 73 comprises a rectangular tube 76 with a draw bar 77 on the tongue front end 74 for receiving a trailer hitch (not shown) and a clevis 78 mounted on the tube 76 at the tongue back end 75.

The tongue 73 is pivotally attached to a cross-bar 81 extending between the trusses 16 in front of the second subframe 62 by a tongue mounting bolt 82. The cross-bar 81 includes clevis ends 83 pivotally bolted to cross-bar mounting ears 84 extending forwardly from the hinge mechanisms 25 at the second subframe 62. The cross-bar 81, in conjunction with the rectangular subframes 61–64 helps to maintain the trusses 16 in parallel, spaced relation.

A pivot bar 87 is attached to a hinge mechanisms 25 at the first subframe 61 and to the rectangular tube 76 by ball and socket connections 88 at its opposite ends. The pivot bar 87 centers the tongue 73 within the first subframe 61 and aligns it with the grader longitudinal axis and direction of travel. The ball and socket connections 88 allow for limited movement of the pivot bar 87 from the horizontal so that the tongue 73 can float to a limited extent in a vertical plane. Such vertical tongue movement might result, for example, from relative dislocation between the grader 1 and a tow vehicle caused by changing road surface elevations. A tongue stop 89 extends upwardly from the torque tube 46 of the first blade assembly 11 and provides a lower limit to the vertical travel of the tongue 73.

A pair of extensible and retractible motors comprising double-acting hydraulic power cylinders 91 are provided for skewing the frame 2. Each hydraulic cylinder 91 is pivotally connected to a cylinder mounting ear 92 on a respective side of the rectangular tube 76 and to a cylinder mounting bar 93 extending forwardly from the cross-bar 81. Hydraulic lines 94 communicate the cylinders 91 with a source of pressurized hydraulic fluid (not shown) which may be located, for example, on the tow vehicle.

Each transport wheel assembly 3 includes a pair of wheels 101 with tires 102 and a wheel carriage 103 for extending and retracting the wheel carriage 103 between lowered and raised positions. The wheel carriage 103 includes a pair of triangular wheel carriage subframes 104 comprising base, vertical and hypotenuse members 105, 106 and 107. A wheel carriage pivot tube 111 interconnects the subframes 104 at the intersections of their base and vertical members and is rotatably received within a wheel carriage bushing 112 welded to a respective lower rail 18 and a cord 20. The wheel carriage bushing 112 connection with the truss 16 is reinforced with triangular gussets 113. The wheel carriage subframes 104 are interconnected at the intersections of their vertical and hypotenuse members 106, 107 by a cylinder mounting beam 114. At the intersections of their base and hypotenuse members 105, 107, axles 115 are attached to the subframes 104 for mounting the wheels 101.

A pair of extensible and retractible motors comprising double-acting hydraulic power cylinders 121 are provided for extending and retracting the wheel assemblies 3. Each cylinder 121 is pivotally connected at one end to a cylinder mounting ear 122 welded to a respective lower rail 18 and a cord 20. A cylinder rod clevis end 126 is pivotally connected to a tab 124 positioned in the cylinder mounting beam 114. Hydraulic lines 125 communicate the hydraulic cylinders 121 with the source of pressurized hydraulic fluid.

Figure 4:
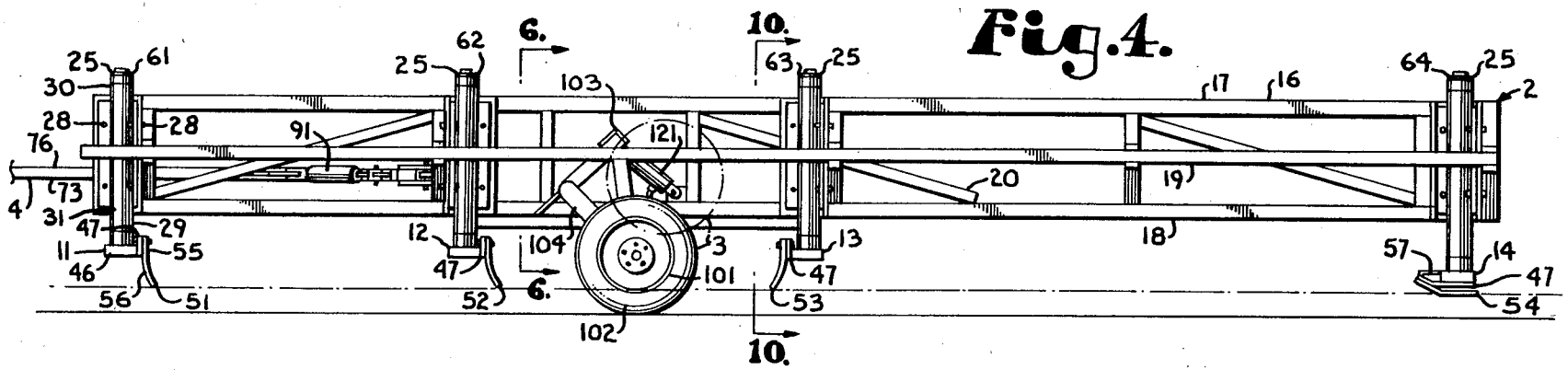
FIG. 4 is a side elevation of the road grader.
Figure 5:
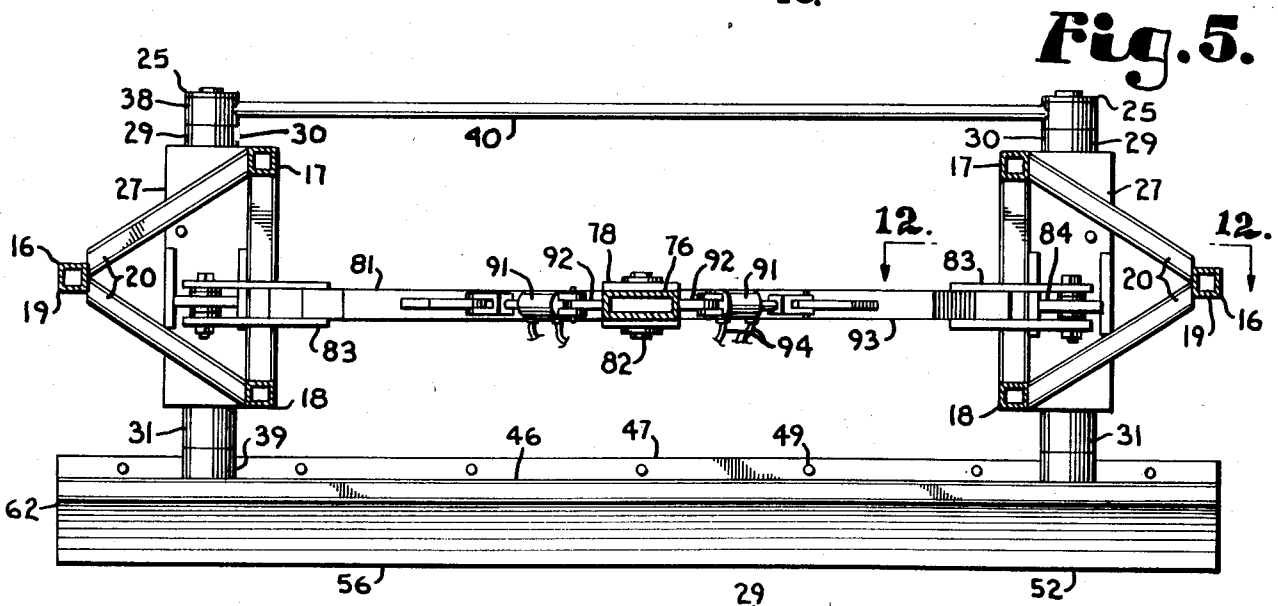
FIG. 5 is a vertical cross section of the road grader taken generally along line 5—5 in FIG. 1.
Figure 6:
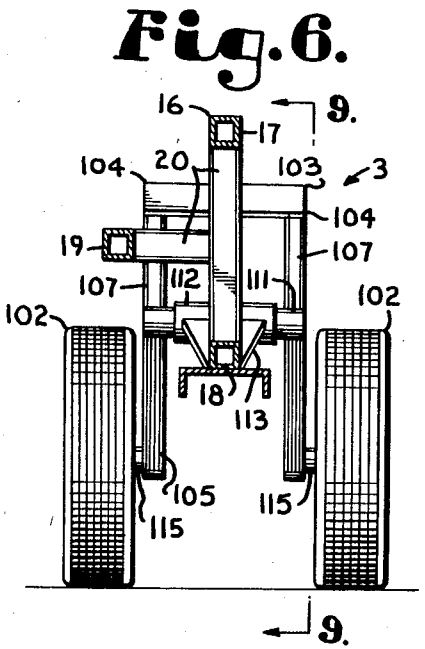
FIG. 6 is a vertical cross section of the road grader taken generally along line 6—6 in FIG. 4.
Figure 7:
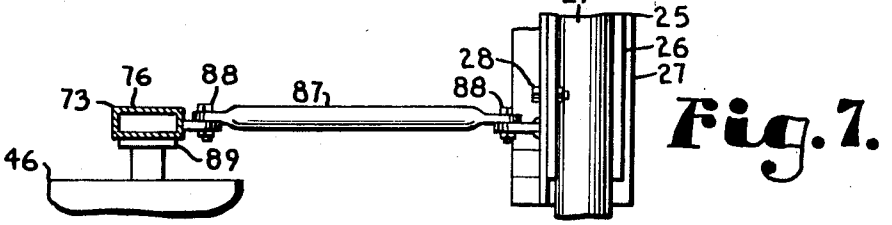
FIG. 7 is a vertical cross section of the road grader taken generally along line 7—7 in FIG. 1.
Figure 9:
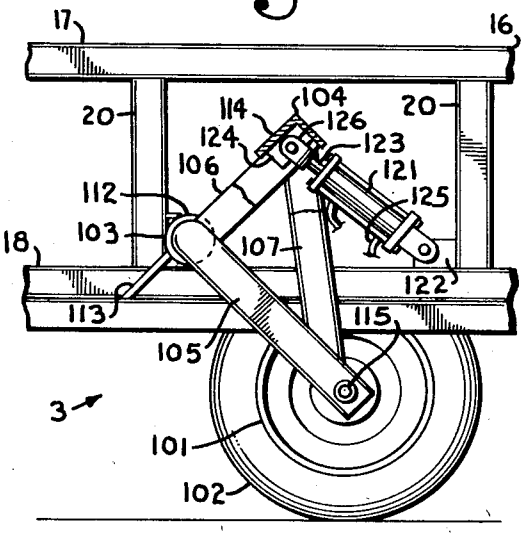
FIG. 9 is a fragmentary side elevation of the road grader particularly showing a transport wheel assembly.
Figure 11:
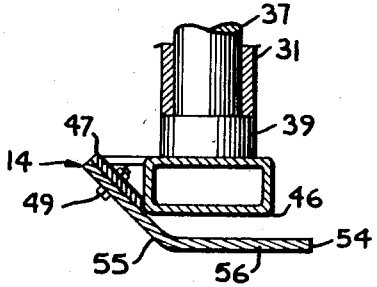
FIG. 11 is a fragmentary, vertical cross section of the road grader particularly showing a compacting blade.
Figure 8:
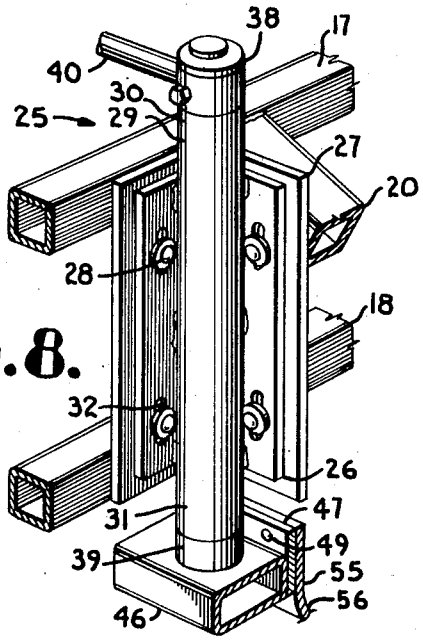
FIG. 8 is a fragmentary perspective of the road grader particularly showing a hinge assembly.
Figure 10:
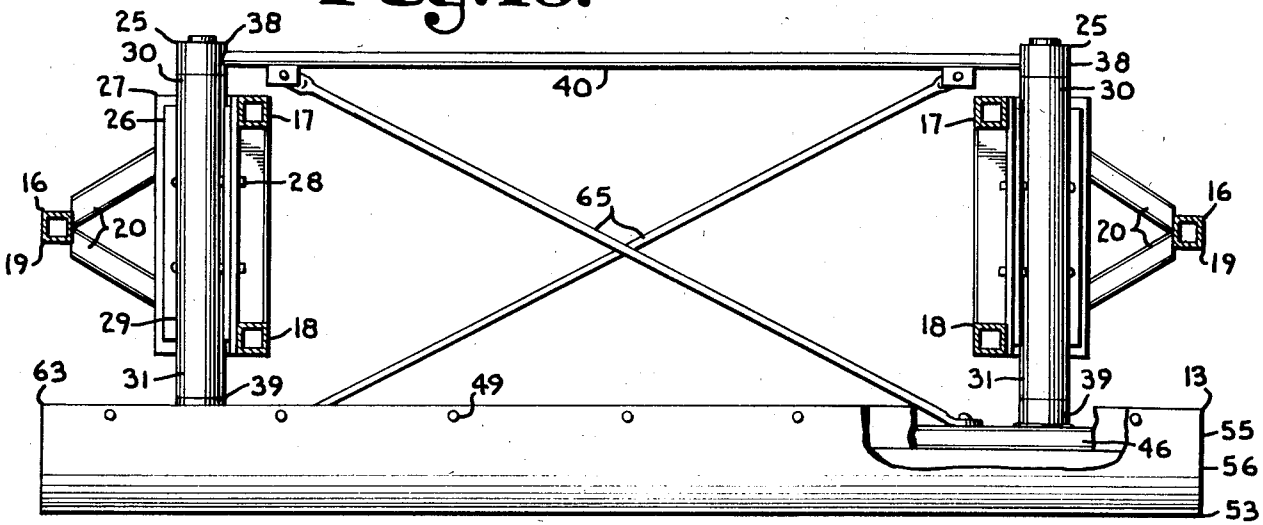
FIG. 10 is a vertical cross section of the road grader taken generally along line 10—10 in FIG. 4.
Figure 12:
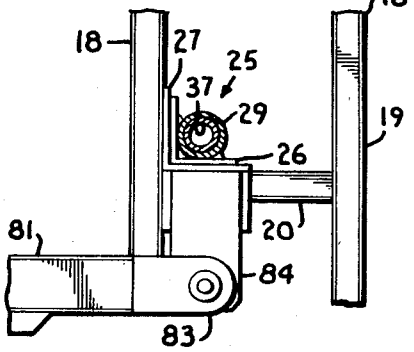
FIG. 12 is a fragmentary horizontal sectional view taken on line 12—12 of FIG. 5 and illustrates details of a hinge assembly.

In operation, the road grader 1 may be transported to a work location by extending (lowering) the transport wheel assemblies 3. As shown in FIG. 4, the axes of the transport wheels 101 extend transversely of the forward half of the frame 2 so that the road grader 1 is tail-heavy in its transport position. The tongue 73 is attached to a tow vehicle and because the grader 1 is tail-heavy, the tongue 73 rests on the tongue stop 89.

Figure 2:
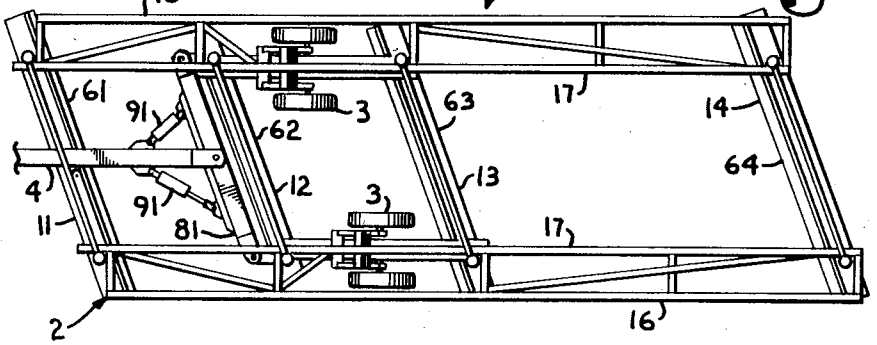
FIG. 2 is a top plan of the road grader in a first skewed configuration.

The transport wheel assemblies 3 are retracted by extending the hydraulic cylinders 121 so that the wheels 101 are positioned above the level of the blades 51–54. The grader 1 is then skewed with the hydraulic cylinders 91. The hydraulic system causes one of the hydraulic cylinders 91 to extend as the other retracts and vice versa so that the frame 2 is skewed to either of the configurations shown in FIGS. 2 and 3 whereby excess road material is strewn laterally to the left or right. Thus, the operator can selectively determine which side of the grader 1 is to receive the excess material therefrom.

The function of the blades 51–54 may be altered by reversing their orientations. For example, the second blade 52 is shown in a scraper orientation. However, by reversing it so that its distal leg 56 extends in the direction of travel it will function as a cutter. The elongated slots 32 allow for adjusting the working depths of the blades 51–54. Vertical adjustments are accomplished by loosening the blade depth adjustment mounting bolts 28, shifting the angle members 26, 27 vertically with respect to each other and retightening the bolts 28 with the blade properly repositioned. Such working depth adjustments may be required to compensate, for example, for differential wear in respective blades 51–54.

It is to be understood that while certain forms of the present invention have been illustrated and described herein, it is not to be limited to the specific forms or arrangement of parts described and shown.

What is claimed and desired to be secured by Letters Patent is as follows:

1. A drag-type road grader, which comprises:

(a) a frame including:

(1) a pair of trusses aligned in parallel relation along a direction of travel of the grader;

(2) a plurality of hinge mechanisms mounted in longitudinally spaced relationship on each said truss, each said hinge mechanism being positioned in transversely opposed relationship with an associated hinge mechanism on the other of said trusses;

(3) a plurality of tie rod means each extending transversely between said trusses and interconnecting an associated pair of said hinge mechanisms;

(b) a plurality of road-working blades extending transversely between said trusses;

(c) a plurality of blade mounting means each mounting a respective blade on an associated pair of said hinge mechanisms;

(d) a tongue assembly including a tongue extending forwardly from said frame along the direction of vehicle travel and tongue connector means adapted for connecting said tongue to said trusses;

(e) a pair of transport wheel assemblies each being movable between a retracted position with the grader in an operating mode and in extended position with the grader in a transport mode, each said wheel assembly being mounted on a respective truss;

(f) power means for skewing said frame whereby said side frame members are shifted longitudinally with respect to each other and said blades are angled with respect to the direction of grader travel;

(g) means adapted for raising and lowering said wheel assemblies; and (h) each said hinge mechanism pivotally mounting in spaced relation a respective tie rod means and blade for pivotal movement with respect to a respective truss about a vertical pivotal axis extending through said hinge mechanism.

2. The road grader according to claim 1 wherein:

(a) each said blade mounting means comprises a torque tube with opposite ends each connected to a respective hinge assembly.

3. The road grader according to claim 1, wherein each said transport wheel assembly includes:

(a) a wheel carriage pivotally mounted on a respective truss; and (b) a wheel rotatably mounted on said wheel carriage structure.

4. The road grader according to claim 1, which includes:

(a) a first road-working blade having a vertical proximate leg and a distal leg sloping downwardly and rearwardly;

(b) a second road-working blade having a first proximate leg connected to a respective blade mounting means and a distal leg extending downwardly and rearwardly therefrom;

(c) a third road-working blade having a proximate leg connected to a respective blade mounting means and a distal leg extending downwardly and forwardly therefrom; and (d) a fourth road-working blade including a downwardly and rearwardly sloping proximate leg mounted on a respective blade mounting means and a distal leg extending horizontally and rearwardly therefrom.

5. The grader according to claim 1 wherein:

(a) each said hinge mechanism includes means for vertically adjusting the working depth of a respective blade attached thereto.

6. The grader according to claim 5 wherein each hinge assembly includes:

(a) a first angle member mounted on a respective truss;

(b) a second angle member connected to said first angle member and a respective road working blade;

(c) one of said angle members having a vertically elongated slot extending therethrough;

(d) the other of said angle members including a receiver aligned with said elongated slot; and (e) bolt means extending through said elongated slot and said receiver for vertically adjustably connecting said first and second angle members.

7. The road grader according to claim 1 wherein said tongue assembly includes:

(a) a cross-bar extending between said trusses with said tongue pivotally connected thereto; and (b) a power cylinder having opposite ends connected to said tongue and said cross-bar, said power cylinder being adapted to rotate said cross-bar relative to said tongue whereby said trusses are shifted longitudinally with respect to each other and said frame is skewed.

8. The road grader according to claim 7, which includes:

(a) a pivot bar interconnecting said tongue and one of said trusses, said pivot bar being adapted to maintain said tongue in parallel, spaced relation with said trusses and aligned with the direction of travel of the grader.

9. A road grader, which comprises:

(a) a frame assembly including:

(1) a pair of parallel trusses each having upper, lower and outer longitudinal rails interconnected by cords;

(2) a plurality of hinge mechanisms mounted on each said truss in longitudinally spaced relation, each said hinge assembly having an outer angle member mounted on said truss, an inner angle member vertically adjustably mounted on said outer angle member, a hinge bushing mounted on said inner angle member, a hinge pin rotatably received in said hinge bushing and upper and lower hinge collars mounted on upper and lower ends of said hinge pin respectively; and (3) a plurality of tie rods each attached to an associated pair of said upper collars and extending transversely between said trusses;

(b) a plurality of blade assemblies each including:

(1) a torque tube mounted on an associated pair of lower collars;

(2) a blade mounting bar mounted on said torque tube; and (3) a blade having a proximate leg attached to said blade mounting bar and a distal leg extending from and forming an obtuse angle with respect to said proximate leg;

(c) a tongue assembly, which includes:

(1) a tongue with front and back ends, said tongue front end extending forwardly from said frame assembly;

(2) a crossbar pivotally mounted on and extending between said frame trusses, said tongue back end being pivotally connected to said crossbar;

(3) a pair of power cylinders each having opposite ends connected to said tongue and said crossbar in spaced relation from the pivotal connection therebetween; and (4) a pivot bar having opposite ends, one of said pivot bar ends being pivotally connected to one of said trusses and the other of said pivot bar opposite ends being pivotally connected to said tongue in spaced relation forwardly from said power cylinders; and (d) a pair of wheel assemblies each mounted on a respective truss and including:

(1) a wheel carriage including a pair of wheel carriage subframes, a wheel carriage pivot tube interconnecting said wheel carriage subframes and a wheel carriage bushing mounted on said truss and pivotally receiving said wheel carriage pivot tube;

(2) a pair of wheels each rotatably mounted on a respective wheel carriage subframe; and (3) a wheel assembly power cylinder having opposite ends, one of said power cylinder ends being connected to said truss and the other of said power cylinder opposite ends being connected to said wheel carriage.

10. A drag-type road grader, which comprises:

(a) a plurality of transversely extending road-working blades;

(b) a frame including:

(1) a pair of trusses aligned in parallel relation along a direction of travel of the grader;

(2) a plurality of hinge mechanisms mounted in longitudinally spaced relationship on each truss, each said hinge mechanism being positioned in transversely opposed relationship with an associated hinge mechanism on the other of said trusses and including:

(i) means for vertically adjusting the working depth of a respective blade;

(ii) a first angle member mounted on a respective truss;

(iii) a second angle member connected to said first angle member;

(iv) one of said angle members having a vertically elongated slot extending therethrough;

(v) the other of said angle members including a receiver aligned with said elongated slots;

(vi) bolt means extending through said elongated slot in said receiver for vertically adjustably connecting said first and second angle members;

(vii) a hinge bushing mounted on one of said angle members and a hinge pin rotatably received in said hinge bushing, said hinge pin having upper and lower ends; and (viii) each said hinge pin lower end having a respective blade mounting means connected thereto;

(3) a plurality of tie rod means each extending transversely between said trusses and interconnecting an associated pair of said hinge pin upper ends; and (4) a plurality of rectangular subframes each comprising a respective tie rod means, a respective blade, a respective blade mounting means and an associated pair of hinge pins rigidly interconnected and pivotal with respect to said trusses;

(c) a tongue assembly including a tongue extending forwardly from said frame along the direction of vehicle travel and tongue connector means adapted for connecting said tongue to said trusses;

(d) a pair of transport wheel assemblies each being movable between a retracted position with the grader in an operating mode and an extended position with the grader in a transport mode, each said wheel assembly being mounted on a respective truss;

(e) means for skewing said frame whereby said frame members are shifted longitudinally with respect to each other and said blades are angled with respect to the direction of grader travel; and (f) means adapted for raising and lowering said wheel assemblies.

11. A drag-type road grader, which comprises:

(a) a frame including:

(1) a pair of trusses aligned in parallel relation along a direction of travel of the grader;

(2) a plurality of hinge mechanisms mounted in longitudinally spaced relationship on each said truss, each said hinge mechanism being positioned in transversely opposed relationship with an associated hinge mechanism on the other of said trusses;

(3) a plurality of tie rod means each extending transversely between said trusses and interconnecting an associated pair of said hinge mechanisms;

(b) a plurality of road-working blades extending transversely between said trusses;

(c) a plurality of blade mounting means each mounting a respective blade on an associated pair of said hinge mechanisms;

(d) a tongue assembly including a tongue extending forwardly from said frame along the direction of vehicle travel and tongue connector means adapted for connecting said tongue to said trusses;

(e) a pair of transport wheel assemblies each being movable between a retracted position with the grader in an operating mode and an extended position with the grader in a transport mode and including:

(1) a wheel carriage including a pair of laterally spaced, triangular carriage subframes and a pivot tube interconnecting said carriage subframes and pivotally mounted on a respective truss;

(2) a power cylinder having opposite ends mounted on said truss and said wheel carriage for raising and lowering said wheel assembly; and (3) a wheel rotatably mounted on said wheel carriage;

(f) means for skewing said frame whereby said side frame members are shifted longitudinally with respect to each other and said blades are angled with respect to the direction of grader travel; and (g) means adapted for raising and lowering said wheel assemblies.

12. The road grader according to claim 11 wherein:

(a) each said hinge means includes means for vertically adjusting the working depth of said blade relative to said frame.

* * * * *